US007114837B2

(12) United States Patent
Yagi et al.

(10) Patent No.: US 7,114,837 B2
(45) Date of Patent: Oct. 3, 2006

(54) HEADLAMP FOR VEHICLE

(75) Inventors: Seiichiro Yagi, Shizuoka (JP); Kazutami Oishi, Shizuoka (JP); Takashi Inoue, Shizuoka (JP); Masaru Sasaki, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 164 days.

(21) Appl. No.: 10/819,122

(22) Filed: Apr. 7, 2004

(65) Prior Publication Data

US 2004/0202007 A1 Oct. 14, 2004

(30) Foreign Application Priority Data

Apr. 8, 2003 (JP) ..... P.2003-103674

(51) Int. Cl.
*F21V 14/00* (2006.01)

(52) U.S. Cl. ..... 362/523; 362/545; 362/547; 362/250

(58) Field of Classification Search ..... 362/294, 362/373, 545, 547, 523, 250, 372
See application file for complete search history.

(56) References Cited

U.S. PATENT DOCUMENTS 5,642,935 A * 7/1997 Schmitt ..... 362/528
2001/0030866 A1* 10/2001 Hochstein ..... 362/294
2002/0060910 A1* 5/2002 Knight ..... 362/250
2006/0023461 A1* 2/2006 Knight ..... 362/466

FOREIGN PATENT DOCUMENTS

| | | | |
|---|---|---|---|
| EP | 1 002 696 | A2 | 5/2002 |
| JP | 2001-332104 | A | 11/2001 |
| JP | 2002-93206 | A | 3/2002 |
| JP | 2002-299700 | A | 10/2002 |
| JP | 2003-007104 | A | 1/2003 |
| KR | 1998-033252 | U | 9/1998 |
| WO | WO 2004/007241 | A2 | 1/2004 |
| WO | WO 2004-055433 | A1 | 7/2004 |

* cited by examiner

*Primary Examiner*—Ali Alavi
(74) *Attorney, Agent, or Firm*—Sughrue Mion, PLLC

(57) ABSTRACT

A plurality of lighting units using light emitting diodes as light sources is accommodated in a lamp housing in such a state as to be supported on a common metallic support member provided tiltably. When a part or all of the lighting units are turned on, the light emitting diodes generate heat with a light emission. These light emitting diodes are supported on the common metallic support member. Also in the case in which any of the lighting units is turned on, therefore, the heat generated by the light emitting diodes is moved to the metallic support member having a large heat capacity through boards and light source support blocks by a heat conducting function. Consequently, a rise in the temperatures of the light emitting diodes can be suppressed.

34 Claims, 9 Drawing Sheets

HEADLAMP FOR VEHICLE

The present invention claims priority based on Japanese patent application no. 2003-103674, filed Apr. 8, 2003, the contents of which is incorporated herein by reference.

BACKGROUND OF THE INVENTION

1. Technical Field

The present invention relates to a headlamp for a vehicle, which forms various light distribution patterns by lighting units using a semiconductor light emitting unit as a light source.

2. Related Art

Conventionally, a marker lamp for a vehicle such as a tail lamp has often used a light emitting diode as a light source thereof. For example, related art Japanese publication JP-A-2001-332104 describes a marker lamp for a vehicle in which a plurality of lighting units using a light emitting diode as a light source is arranged.

In recent years, the luminance of a light emitting diode has been enhanced and there is a growing tendency to employ the light emitting diode as a light source of a headlamp for a vehicle.

When the luminance of the light emitting diode is enhanced, however, a calorific power thereof is also increased. For this reason, there is a problem in that the luminous flux of a light source is decreased or a luminescent color is changed due to a rise in the temperature of the light emitting diode, resulting in an improper light source of a headlamp for a vehicle.

SUMMARY OF THE INVENTION

In consideration of such circumstances, it is an object of the invention to provide a headlamp for a vehicle which forms light distribution patterns by lighting units using a semiconductor light emitting unit as a light source, in which a rise in the temperature of the semiconductor light emitting unit can be suppressed. However, the present invention does not require such an object, nor does it require that any object to be achieved.

The invention provides a structure in which a plurality of lighting units is supported on a common metallic support member provided tiltably.

More specifically, the invention provides a headlamp for a vehicle in which a plurality of lighting units using a semiconductor light emitting unit as a light source is accommodated in a lamp housing formed by a lamp body and a translucent cover attached to an opening portion on a front end of the lamp body and plural kinds of light distribution patterns are formed by these lighting units, wherein the lighting units are supported on a common metallic support member provided tiltably.

The type of the "semiconductor light emitting unit" is not particularly restricted but a light emitting diode and a laser diode can be employed, for example but not by way of limitation. Moreover, the specific structure of the "semiconductor light emitting unit" is not particularly restricted but a single light emitting chip may be mounted or a plurality of light emitting chips may be mounted, for example but not by way of limitation.

If at least two of the "lighting units" are constituted to form different light distribution patterns from each other, the specific structure of each of the lighting units is not particularly restricted.

If the "metallic support member" is a metallic member for supporting the lighting units and is provided tiltably, a specific structure thereof is not particularly restricted. The "metallic" includes one type of metal, and furthermore, an alloy formed by at least two types of metal. Moreover, the direction of a "tilt" of the metallic support member is not particularly restricted but it is possible to employ a tilting manner in vertical and transverse directions, a tilting manner in only the vertical direction and a tilting manner in only the transverse direction.

As shown in the structure, the invention provides a headlamp for a vehicle in which a plurality of lighting units using a semiconductor light emitting unit as a light source is accommodated in a lamp housing formed by a lamp body and a translucent cover attached to an opening portion on a front end thereof and plural kinds of light distribution patterns are formed by these lighting units, wherein the lighting units are supported on a common metallic support member provided tiltably. Therefore, it is possible to obtain the following functions and advantages.

More specifically, in the headlamp for a vehicle according to the invention, a part or all of the lighting units constituted to form plural kinds of light distribution patterns are turned on. At this time, the semiconductor light emitting units of the lighting units to be lighting objects generate heat with the light emission of the semiconductor light emitting units. In that case, these lighting units are supported on the common metallic support member. Also, when any of the lighting units is turned on, therefore, the heat generated by the semiconductor light emitting unit of the lighting unit is moved to the metallic support member having a large heat capacity by a heat conducting function. Consequently, a rise in the temperature of the semiconductor light emitting unit can be suppressed.

According to the invention, it is possible to suppress the rise in the temperature of the semiconductor light emitting unit in the headlamp for a vehicle which is constituted to form plural kinds of light distribution patterns by a plurality of lighting units using the semiconductor light emitting unit as a light source. Consequently, it is possible to suppress a decrease in the luminous flux of the light source of the semiconductor light emitting unit and a change in a luminescent color.

In addition, in the headlamp for a vehicle according to the invention, the metallic support member is provided tiltably. By tilting the metallic support member, therefore, it is possible to collectively carry out an aiming adjustment for the lighting units.

In the structure, the specific structure of the metallic support member is not particularly restricted as described above. If the metallic support member is constituted by a plate-shaped member formed like a step, however, the support can be carried out in such a state that the lighting units are arranged three-dimensionally corresponding to the shape of the lamp housing. In addition, the surface area of the metallic support member can be increased to enhance a radiating function thereof.

In the structure, if a plurality of radiation fins is formed on the back face of the metallic support member, the surface area of the metallic support member can further be increased to enhance the radiating function thereof still more.

The metallic support member may be wholly accommodated in the lamp housing. If the metallic support member is formed to be extended to an external space of the lamp housing, it is possible to efficiently cool the metallic support member by the radiating function to the external space, thereby suppressing a rise in the temperature of the semiconductor light emitting unit more effectively.

In this case, when an exposing position of the metallic support member to the external space is set into a peripheral wall portion of the lamp body, the metallic support member can be efficiently cooled by a vehicle running wind. Consequently, it is possible to suppress the rise in the temperature of the semiconductor light emitting unit still more effectively. The "peripheral wall portion" implies a wall portion positioned around the lamp body as seen from the front of the lighting unit, and a lower wall portion, an upper wall portion and a side wall portion are equivalent thereto, for example but not by way of limitation.

In that case, when the metallic support member is constituted to include a support member body, a heat sink exposed to the external space, and a heat pipe provided to couple the heat sink to the support member body, the heat of the semiconductor light emitting unit can be efficiently transferred from the support member body to the heat sink through the heat pipe, and furthermore, a radiation to the external space can be efficiently carried out in the heat sink.

In the structure, when the metallic support member is tiltably supported by a plurality of aiming screws and at least one of the aiming screws is constituted by a heat pipe, it is possible to carry out the radiation to the external space without forming a new opening portion on the lamp body.

In the structure, when a part of the metallic support member is constituted by at least one heat pipe extended to a vicinal position of a lower end of the translucent cover, the following functions and advantages can be obtained.

More specifically, the lowest temperature is obtained in the lamp housing in the vicinal position of the lower end of the translucent cover. If the heat pipe can be extended to the vicinal position of the lower end of the translucent cover, therefore, the metallic support member can be cooled efficiently. In addition, warm air is brought up by a heat exchange in the tip portion of the heat pipe at this time so that the translucent cover can be warmed up at an internal surface side thereof. Also in the case in which a blur is generated on the internal surface of the translucent cover, therefore, it can be eliminated in an early stage. Moreover, a frost or snow sticking to the external surface of the translucent cover can also be eliminated in the early stage.

In the structure, it is also possible to constitute at least a part of the lamp body by the metallic support member. In such a case, the metallic support member can be exposed to the external space of the lamp housing over a wide range. Consequently, a rise in the temperature of the semiconductor light emitting unit can be suppressed very effectively.

DETAILED DESCRIPTION OF THE INVENTION

An embodiment of the invention will be described below with reference to the drawings.

Figure 1:
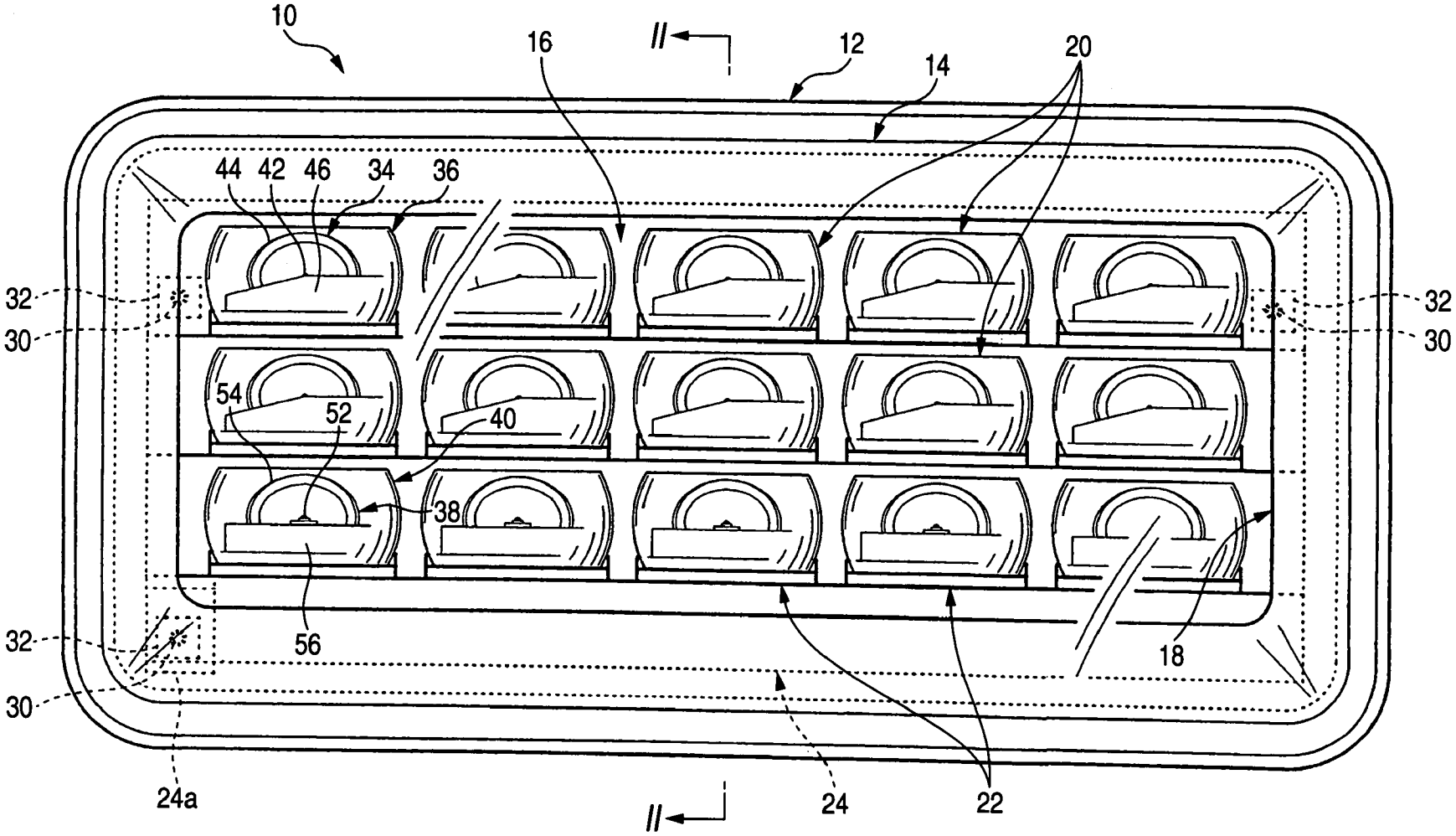
FIG. 1 is a front view showing a headlamp for a vehicle according to an exemplary, non-limiting embodiment of the present invention.
Figure 2:
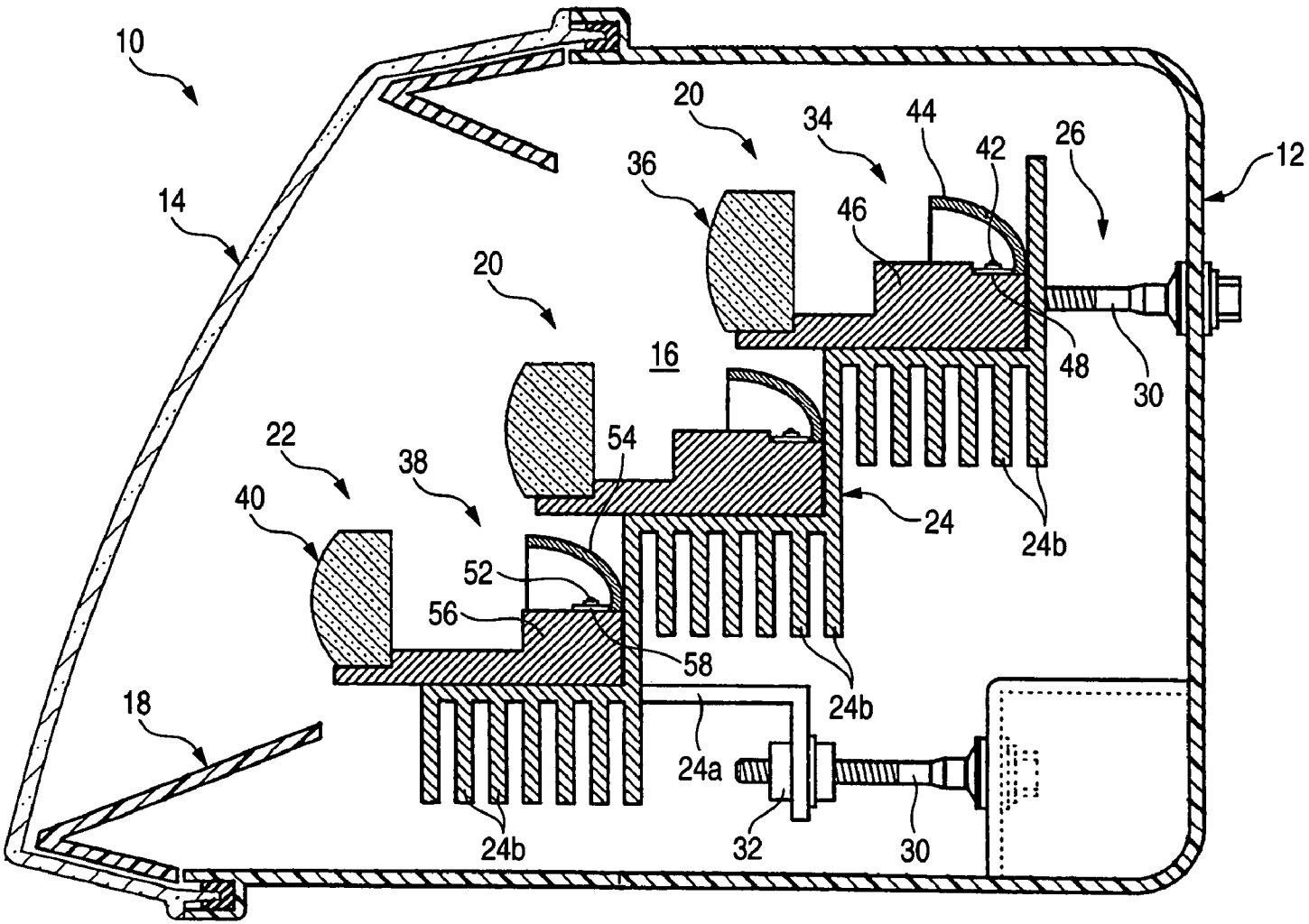
FIG. 2 is a sectional view taken along a II—II line in FIG. 1 according to the exemplary, non-limiting embodiment of the present invention.

FIG. 1 is a front view showing a headlamp 10 for a vehicle according to an embodiment of the invention, and FIG. 2 is a sectional view taken along a II—II line in FIG. 1.

In the headlamp 10 for a vehicle, 15 lighting units 20 and 22 are accommodated in a lamp housing 16 formed by a lamp body 12 and a translucent cover 14 attached to an opening portion on a front end thereof, every five lighting units 20 and 22 being arranged in three vertical stages, and an extension reflector 18 is provided on a front end in the lamp housing 16 in order to substantially surround these lighting units 20 and 22.

Ten lighting units 20 positioned in upper and middle stages serve to form a light distribution pattern for a low beam, and five lighting units 22 positioned in a lower stage are additionally turned on when a light distribution pattern for a high beam is to be formed.

These 15 lighting units 20 and 22 are supported on a common metallic support member 24. The metallic support member 24 is formed by a plate-shaped member formed like a step and is provided tiltably in vertical and transverse directions by an aiming mechanism 26. For the metallic support member 24, five of the 15 lighting units 20 and 22 are mounted and fixed onto the upper surface of each stage portion. Moreover, a plurality of radiation fins 24*b* is formed on the back face of the metallic support member 24. The fins 24*b* protrude downward from the lower surface of each stage portion thereof.

The aiming mechanism 26 includes three aiming screws 30. Each of the aiming screws 30 has a base end rotatably supported on the lamp body 12 and a tip portion engaged with and coupled to the metallic support member 24 through an aiming nut 32. In that case, the aiming nut 32 is attached to an L-shaped bracket 24*a* extended rearward from the metallic support member 24 in the lower portion of the metallic support member 24.

In the aiming mechanism 26, a predetermined one of the aiming screws 30 is properly rotated by means of a driver, thereby tilting the metallic support member 24 in the vertical or transverse direction. Consequently, an aiming adjustment for the 15 lighting units 20 and 22 is collectively carried out.

Each of the lighting units 20 is constituted as a projector type lighting unit including a light source unit 34 and a projection lens 36 provided on a forward side thereof. Moreover, each of the lighting units 22 is constituted as a projector type lighting unit including a light source unit 38 and a projection lens 40 provided on a forward side thereof.

Next, description will be given to the specific structure of each of the lighting units 20 and 22. The structure of the lighting unit 20 will be described first.

Figure 3:
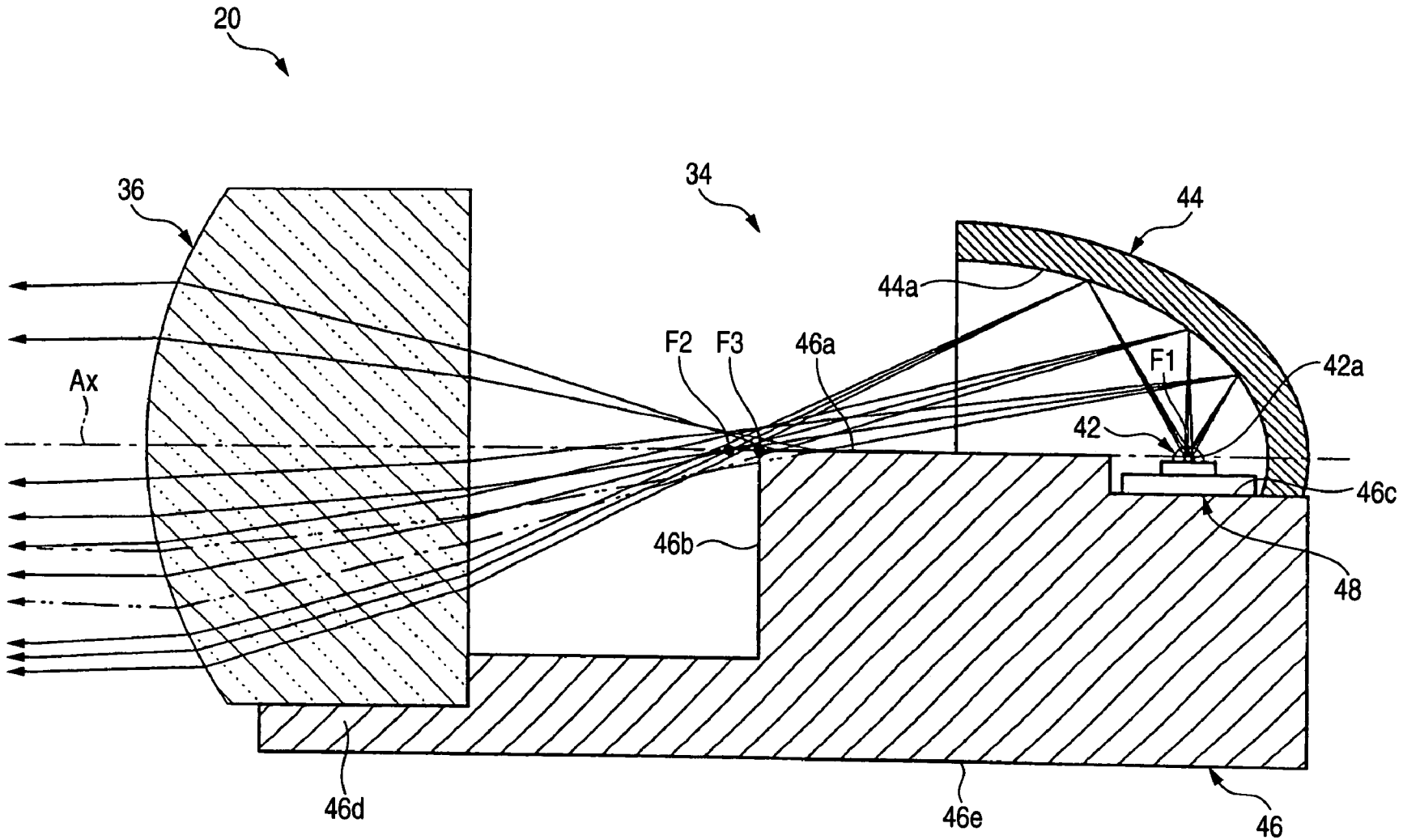
FIG. 3 is a sectional side view showing, as a single product, a lighting unit for forming a light distribution pattern for a low beam in the headlamp for a vehicle according to an exemplary, non-limiting embodiment of the present invention.

FIG. 3 is a sectional side view showing the lighting unit 20 as a single product. The light source unit 34 of the lighting unit 20 comprises a light emitting diode 42 as a light source, a reflector 44 and a light source support block 46, and has an optical axis Ax extended in the longitudinal direction of a vehicle.

The light emitting diode 42 is a white light emitting diode including a light emitting chip 42*a* having a size of approximately 1 mm square, and is provided in such a direction as to be rotated by 15 degrees in a rightward direction around the optical axis Ax with respect to an upper part in a vertical direction on the optical axis Ax in a state in which it is supported on a board 48 having a thermal conductivity.

The reflector 44 is an almost dome-shaped member provided on the upper side of the light emitting diode 42, and has a reflecting plane 44*a* for forward collecting and reflecting a light emitted from the light emitting diode 42 close to the optical axis Ax. The reflecting plane 44*a* is formed to take the shape of an almost ellipse and sphere setting the optical axis Ax to be a central axis. A distance in a vertical direction from the light emitting diode 42 to the reflecting plane 44*a* is set to be approximately 10 mm.

More specifically, the reflecting plane 44*a* has a sectional shape including the optical axis Ax to take an almost elliptical shape, and an eccentricity thereof is set to be gradually increased from a vertical section toward a horizontal section. A vertex on the rear side of the ellipse forming each of the sections is set into the same position. The light emitting diode 42 is provided on a first focal point F1 of the ellipse forming the vertical section of the reflecting plane 44*a*. Consequently, the reflecting plane 44*a* forward collects and reflects the light emitted from the light emitting diode 42 close to the optical axis Ax, and almost converges the light on a second focal point F2 of the ellipse in the vertical section including the optical axis Ax in that case.

A projection lens 36 of the lighting unit 20 is constituted by a plano-convex lens having a forward surface to be convex and a rear surface to be flat, and has both upper and lower sides thereof which are chamfered to take an oblong shape seen from the front of the lighting unit. The projection lens 36 is provided on the optical axis Ax in such a manner that a rear side focal point F3 thereof is positioned slightly behind the second focal point F2 of the reflecting plane 44*a* of the reflector 44. Consequently, an image on a focal plane including the rear side focal point F3 is forward projected as an inverted image.

The light source support block 46 is constituted by a metallic block-shaped member provided under the reflector 44. The lower end of the light source support block 46 is forward extended and supports the projection lens 36 at a front end extended portion 46*d*. An upper end face 46*a* of the light source support block 46 is formed to be almost turned down at corners as seen from the front of the lighting unit. The upper end face 46*a* is subjected to a reflecting plane processing. Consequently, a light control plane is formed. The light source support block 46 carries out a control for upward reflecting a part of a light reflected from the reflecting plane 44*a* over the upper end face 46*a*, thereby converting a light to be upward emitted from the projection lens 36 into a light to be downward emitted from the projection lens 36. Thus, the luminous flux utilization factor of a light emitted from the light emitting diode 42 can be increased.

More specifically, the upper end face 46*a* is extended horizontally in a leftward direction from the optical axis Ax and is extended obliquely and downward at 15 degrees in a rightward direction from the optical axis Ax, and is formed in such a manner that a front edge thereof (that is, a ridge line between the upper end face 46*a* and a front end face 46*b* of the light source support block 46) passes through the rear side focal point F3 of the projection lens 36. A part of the light emitted from the light emitting diode 42 and reflected by the reflecting plane 44*a* of the reflector 44 is incident on the upper end face 46*a* of the light source support block 46 and the residual light is exactly incident on the projection lens 36. In that case, the light incident on the upper end face 46*a* is reflected upward by the upper end face 46*a* and is then incident on the projection lens 36, and is emitted as a downward light from the projection lens 36.

A board support portion 46*c* is formed on the rear end of the light source support block 46, and the board 48 is fixed to the light source support block 46 at the board support portion 46*c*. Moreover, the reflector 44 is fixed to the light source support block 46 at a lower end peripheral edge portion thereof. The light source unit 34 is fixed to the metallic support member 24 at a lower end face 46*e* of the light source support block 46.

Next, the structure of the lighting unit 22 will be described.

Figure 4:
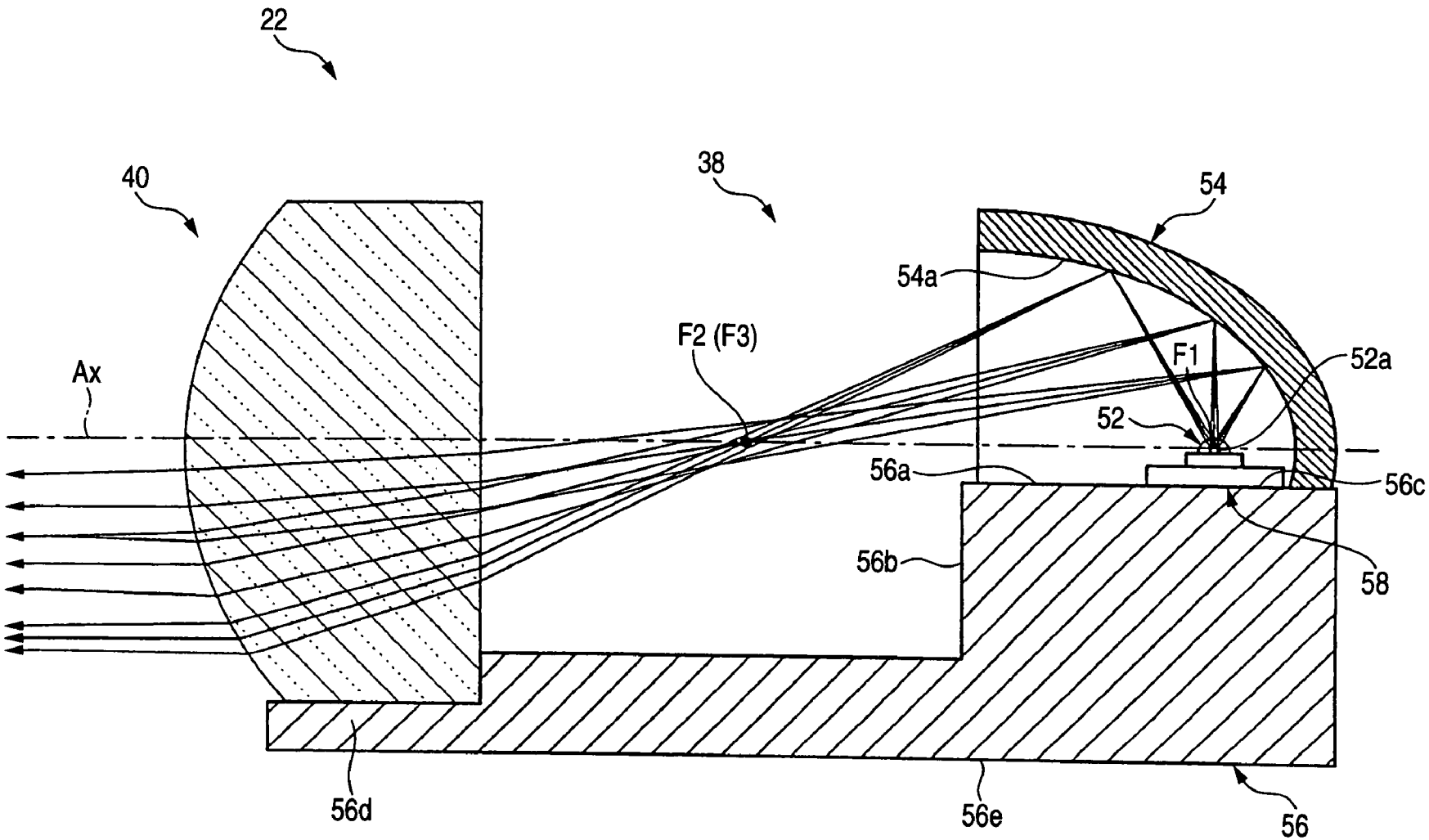
FIG. 4 is a sectional side view showing, as a single product, a lighting unit to be additionally turned on when forming a light distribution pattern for a high beam in the headlamp for a vehicle according to an exemplary, non-limiting embodiment of the present invention.

FIG. 4 is a sectional side view showing the lighting unit 22 as a single product. A light source unit 38 of the lighting unit 22 comprises a light emitting diode 52 to be a light source, a reflector 54 and a light source support block 56, and has an optical axis Ax extended in the longitudinal direction of a vehicle.

The light emitting diode 52 is a white light emitting diode including a light emitting chip 52*a* having a size of approximately 1 mm square, and is provided upward in a vertical direction over the optical axis Ax in such a state as to be supported on a board 58 having a thermal conductivity.

The reflector 54 is an almost dome-shaped member provided on the upper side of the light emitting diode 52, and has a reflecting plane 54*a* for forward collecting and reflecting a light emitted from the light emitting diode 52 close to the optical axis Ax. The reflecting plane 54*a* is formed to take the shape of an almost ellipse and sphere setting the optical axis Ax to be a central axis, and a distance in a vertical direction from the light emitting diode 52 to the reflecting plane 54*a* is set to be approximately 10 mm.

More specifically, the reflecting plane 54*a* has a sectional shape including the optical axis Ax to take an almost elliptical shape, and an eccentricity thereof is set to be gradually increased from a vertical section toward a horizontal section. A vertex on the rear side of the ellipse forming each of the sections is set into the same position. The light emitting diode 52 is provided on a first focal point F1 of the ellipse forming the vertical section of the reflecting plane 54*a*. Consequently, the reflecting plane 54*a* forward collects and reflects the light emitted from the light emitting diode 52 close to the optical axis Ax, and almost converges the light on a second focal point F2 of the ellipse in the vertical section including the optical axis Ax in that case.

A projection lens 40 of the lighting unit 22 is constituted by a plano-convex lens having a forward surface to be convex and a rear surface to be flat, and has both upper and lower sides thereof which are chamfered to take an oblong shape seen from the front of the lighting unit. The projection lens 40 is provided on the optical axis Ax in such a manner that a rear side focal point F3 thereof is almost coincident with the second focal point F2 of the reflecting plane 54*a* of the reflector 54. Consequently, an image on a focal plane including the rear side focal point F3 is forward projected as an inverted image.

The light source support block 56 is constituted by a metallic block-shaped member provided under the reflector 54. The lower end of the light source support block 56 is forward extended and supports the projection lens 40 at a front end extended portion 56*d*. The light source support block 56 has an upper end face 56*a* formed like a horizontal plane slightly under the optical axis Ax, and furthermore, has a front end face 56*b* formed in a very rear position from the rear side focal point F3 of the projection lens 40. Consequently, the light reflected from the reflecting plane 54*a* is exactly incident on the projection lens 40 without shielding through the light source support block 56.

The rear end of the light source support block 56 is provided with a board support portion 56*c* on a level with the upper end face 56*a*. In the board support portion 56*c*, the board 58 is fixed to the light source support block 56. Moreover, the reflector 54 is fixed to the light source support block 56 in the peripheral edge portion of a lower end thereof. The light source unit 38 is fixed to the metallic support member 24 at the lower end face 56*d* of the light source support block 56.

Figure 5:
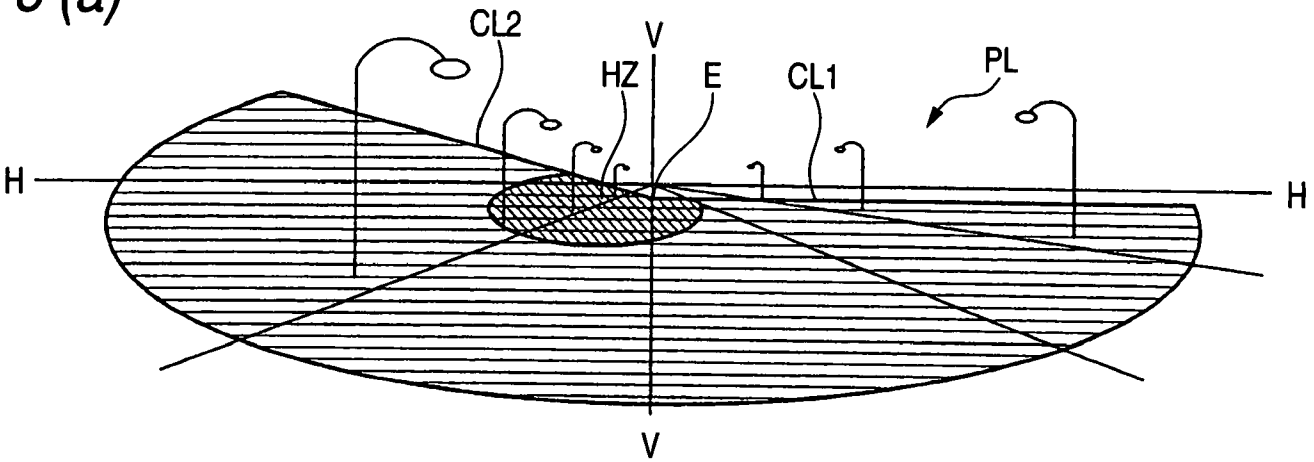
FIGS. 5*a* and 5*b* are perspective views showing a light distribution pattern formed on a virtual vertical screen provided in a forward position of about 25 m from the lighting unit by a light irradiation from the headlamp for a vehicle according to an exemplary, non-limiting embodiment of the present invention.
Figure 5:
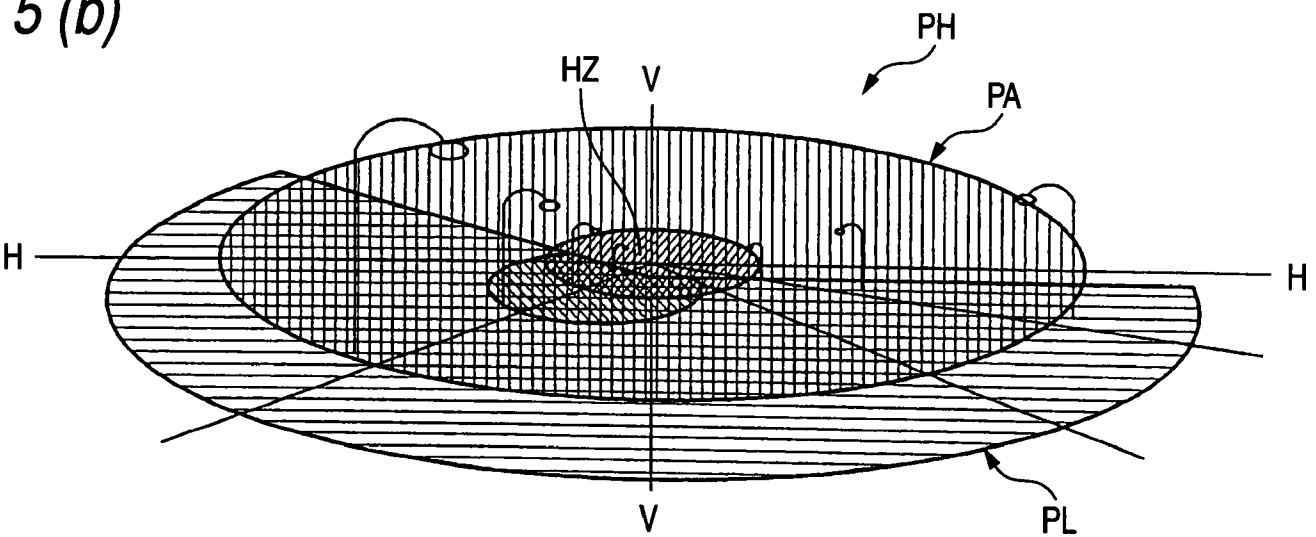

FIGS. 5(*a*)–(*b*) illustrate a perspective view showing a light distribution pattern formed on a virtual vertical screen provided in a forward position of about 25 m from the lighting unit through a light irradiated forward from the headlamp 10 for a vehicle. A light distribution pattern shown in FIG. 5(*a*) is a light distribution pattern PL for a low beam, and a light distribution pattern shown in FIG. 5(*b*) is a light distribution pattern PH for a high beam.

The light distribution pattern PL for a low beam is formed as a synthetic light distribution pattern obtained by ten light distribution patterns formed by a light irradiation from the ten lighting units 20. The light distribution pattern PL for a low beam is a left light distribution pattern having horizontal and oblique cutoff lines CL1 and CL2 at an upper edge thereof, and the position of an elbow point E to be an intersection of both of the cutoff lines is set to be a position placed under H–V by approximately 0.5 to 0.6 degree which is a vanishing point in the direction of the front of the lighting unit. In the light distribution pattern PL for a low beam, a hot zone HZ to be a high luminous intensity region is formed to surround the elbow point E slightly close to the left.

On the other hand, the light distribution pattern PH for a high beam is obtained by superposing an additional light distribution pattern PA on the light distribution pattern PL for a low beam. The additional light distribution pattern PA is extended to the left and right around the H–V and is formed as a synthetic light distribution pattern obtained by five light distribution patterns formed by a light irradiation from the five lighting units 22. In the light distribution pattern PH for a high beam, the hot zone HZ is formed in the vicinity of the H–V.

Next, description will be given to the functions and advantages of this exemplary, non-limiting embodiment of the present invention.

In the headlamp 10 for a vehicle according to this embodiment, a plurality of lighting units 20 and 22 using the light emitting diodes 42 and 52 as light sources is accommodated in the lamp housing 16 formed by the lamp body 12 and the translucent cover 14 attached to an opening portion on a front end thereof and plural kinds of light distribution patterns PL and PH are formed by these lighting units 20 and 22, and the lighting units 20 and 22 are supported on the common metallic support member 24 provided tiltably.

As a result, it is possible to obtain the following functions and advantages. For example, but not by way of limitation, in the headlamp 10 for a vehicle according to the embodiment, a part or all of the lighting units 20 and 22 constituted to form plural kinds of light distribution patterns PL and PH are turned on. At this time, the light emitting diodes 42 and 52 of the lighting units 20 and 22 to be lighting objects generate heat with the light emission of the light emitting diodes 42 and 52. In that case, these lighting units 20 and 22 are supported on the common metallic support member 24.

When any of the lighting units 20 and 22 is turned on, the heat generated by the light emitting diodes 42 and 52 of the lighting units 20 and 22 is moved to the metallic support member 24 having a large heat capacity through the boards 48 and 58 and the light source support blocks 46 and 56 by a heat conducting function. Consequently, a rise in the temperatures of the light emitting diodes 42 and 52 can be suppressed. Thus, it is possible to suppress a decrease in the luminous fluxes of the light sources of the light emitting diodes 42 and 52 and a change in a luminescent color.

In addition, in the headlamp for a vehicle according to the embodiment, the metallic support member 24 is provided tiltably. Therefore, the metallic support member 24 is tilted by means of the aiming mechanism 26 so that an aiming adjustment for the lighting units 20 and 22 can be collectively carried out.

In this exemplary, non-limiting embodiment of the present invention, the metallic support member 24 is constituted by a plate-shaped member formed like a step. Therefore, the support can be carried out in such a state that the lighting units 20 and 22 are arranged three-dimensionally corresponding to the shape of the lamp housing 16. In addition, the surface area of the metallic support member 24 can be increased to enhance a radiating function thereof.

In this embodiment, furthermore, a plurality of radiation fins 24*b* is formed on the back face of the metallic support member 24. Therefore, the surface area of the metallic support member 24 can further be increased to substantially enhance the radiating function thereof.

Next, a first variant of the exemplary, non-limiting embodiment of the present invention will be described.

Figure 6:
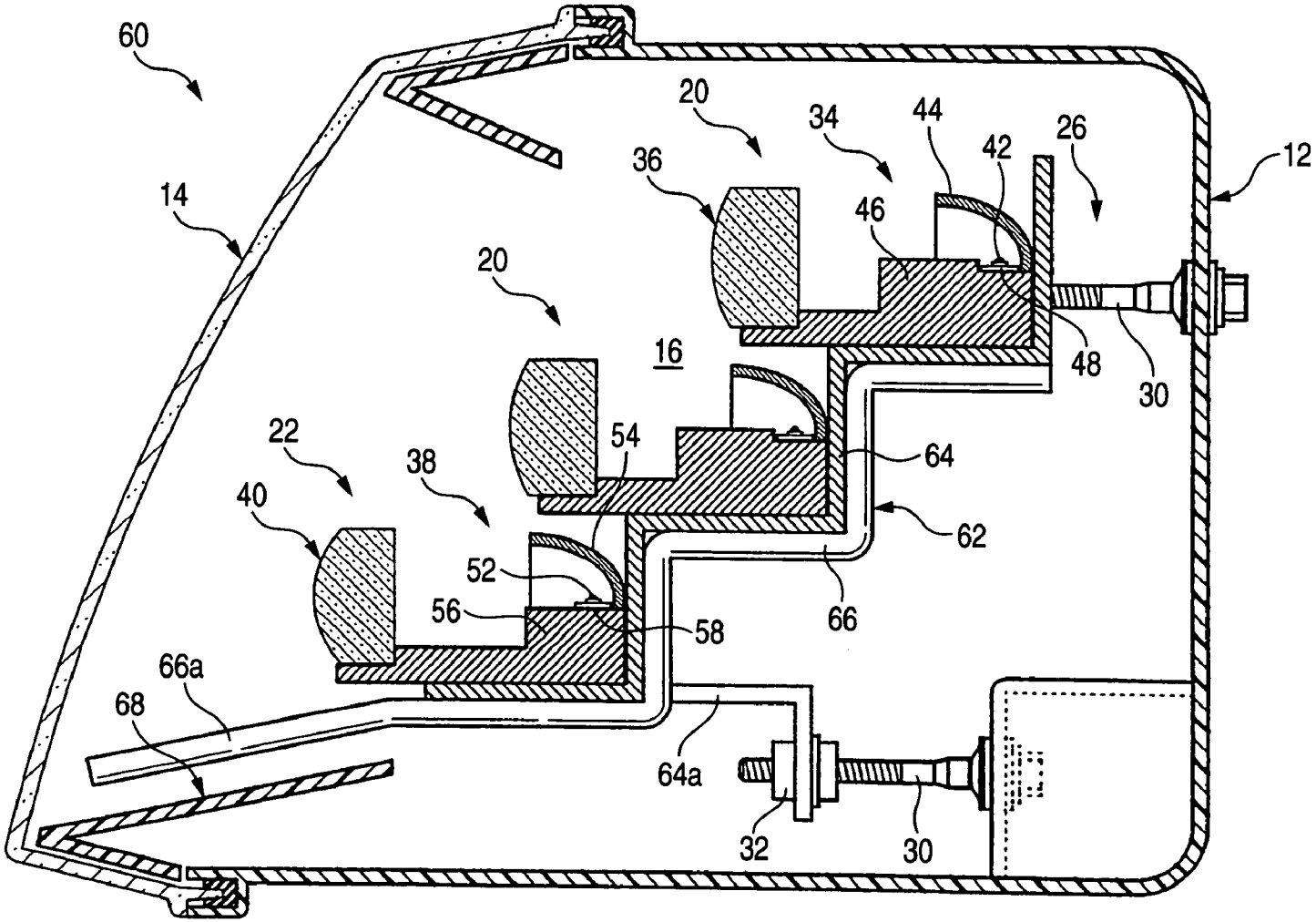
FIG. 6 is the same type of view as FIG. 2, illustrating a headlamp for a vehicle according to a first variant of the exemplary, non-limiting embodiment of the present invention.

FIG. 6 is the same view as FIG. 2, illustrating a headlamp 60 for a vehicle according to the variant. The headlamp 60 for a vehicle has the same basic structure as that of the embodiment, and the structure of a metallic support member 62 is different from that of the metallic support member 24 according to the first exemplary, non-limiting embodiment of the present invention.

More specifically, the metallic support member 62 according to the variant does not have the radiation fin 24*b* formed on a back face thereof, but is instead constituted by a support member body 64 formed like a step and a plurality of heat pipes 66 formed like a step along the back face of the support member body 64. The heat pipes 66 are provided in five portions corresponding to the trains of the lighting units 20 and 22 provided in five lines in a transverse direction, and a tip portion 66*a* on a lower end side thereof is extended slightly downward and forward to the vicinal position of the lower end of a translucent cover 14. The same bracket 64*a* is formed on the back face of the support member body 64.

In this exemplary, non-limiting variant, the tip portion 66*a* of each of the heat pipes 66 is extended to the vicinal position of the lower end of the translucent cover 14. For this reason, an extension reflector 68 has a lower region formed slightly close to a lower portion. Consequently, interference with the heat pipe 66 can be avoided.

By employing the structure according to the variant, it is possible to obtain various functions and advantages. For example, but not by way of limitation, the lowest temperature is obtained in a lamp housing 16 in the vicinal position of the lower end of the translucent cover 14. By providing the heat pipe 66 to be extended to the vicinal position of the lower end of the translucent cover 14, it is possible to efficiently cool the support member body 64. In addition, warm air is brought up by a heat exchange in the tip portion 66*a* of each of the heat pipes 66 at this time so that the translucent cover 14 can be warmed up at an internal surface side thereof.

Additionally, a blur generated on the internal surface of the translucent cover 14 can be eliminated in an early stage. Moreover, a frost or snow sticking to the external surface of the translucent cover 14 can also be eliminated in the early stage.

Next, description will be given to a second exemplary, non-limiting variant of this exemplary embodiment of the present invention.

Figure 7:
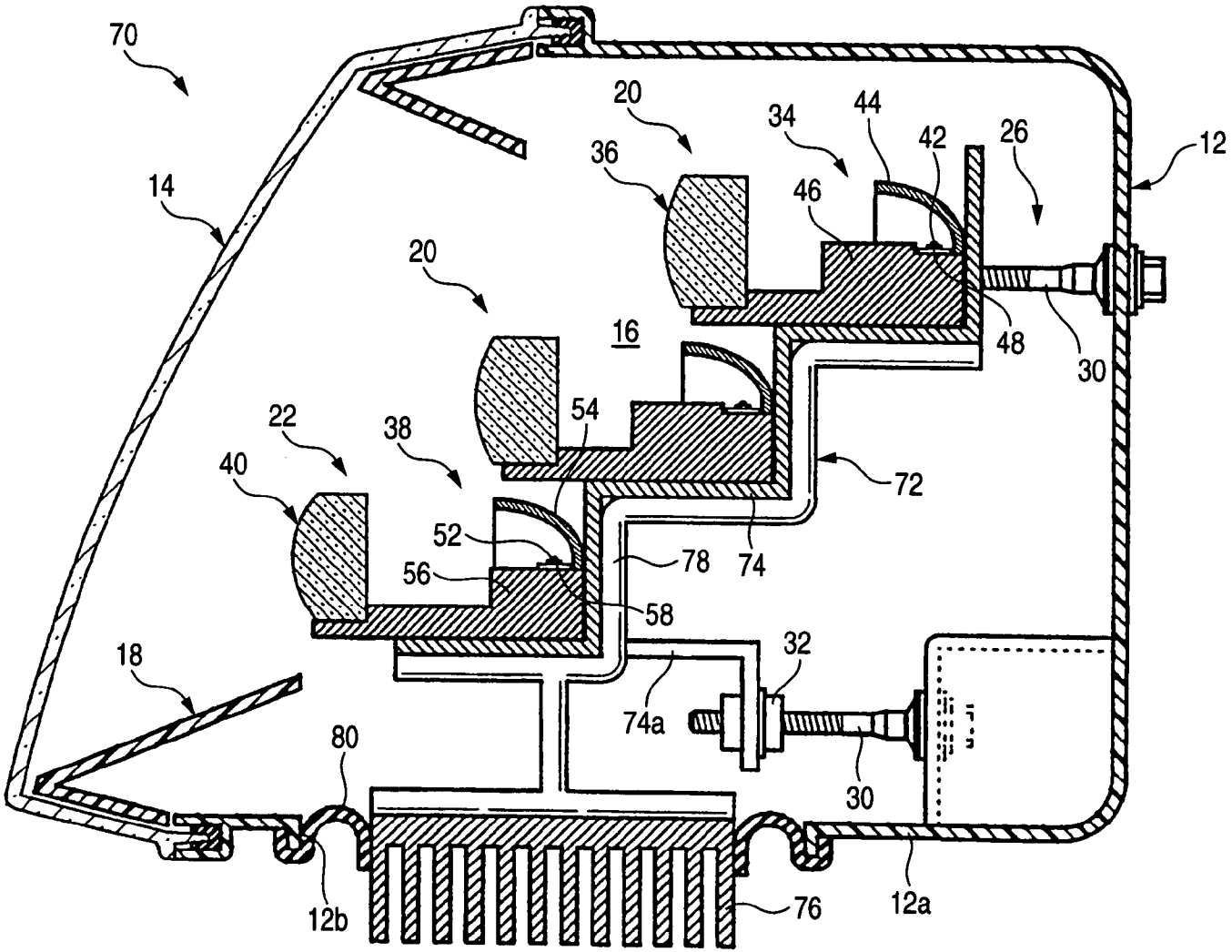
FIG. 7 is the same type of view as FIG. 2, illustrating a headlamp for a vehicle according to a second exemplary variant of the exemplary, non-limiting embodiment of the present invention.

FIG. 7 is the same view as FIG. 2, illustrating a headlamp 70 for a vehicle according to the variant. The headlamp 70 for a vehicle has the same basic structure as that of the first embodiment, and the structure of a metallic support member 72 is different from that of the metallic support member 24 according to the embodiment described below and illustrated in FIG. 7.

The metallic support member 72 according to the second variant does not have the radiation fin 24*b* in the embodiment provided on a back face thereof but is formed to be extended to the external space of a lamp housing 16. More specifically, the metallic support member 72 includes a support member body 74 formed like a step, a heat sink 76 exposed to the external space, and a heat pipe 78 provided to couple the heat sink 76 to the support member body 74. In that case, the heat sink 76 protrudes downward from a lower wall portion 12*a* of a lamp body 12.

To implement the foregoing, a slightly larger opening portion 12*b* than the heat sink 76 is formed on the lower wall portion 12*a* of the lamp body 12. Packing 80 formed of rubber is attached to the opening portion 12*b* to surround the heat sink 76. Consequently, an aiming adjustment can be carried out, and furthermore, the opening portion 12*b* can be sealed. The same bracket 74*a* as that of the embodiment is formed on the back face of the support member body 74.

By employing the structure according to the variant, it is possible to obtain various functions and advantages. For example, but not by way of limitation, the metallic support member 72 is extendable to the external space of the lamp housing 16. Therefore, it is possible to efficiently cool the metallic support member 72 by the radiating function to the external space. Consequently, it is possible to suppress a rise in the temperatures of light emitting diodes 42 and 52 more effectively.

Further, the exposing position of the metallic support member 72 to the external space is set into the lower wall portion 12*a*. Therefore, it is possible to efficiently cool the metallic support member 72 by a vehicle running wind. Consequently, it is possible to suppress the rise in the temperatures of the light emitting diodes 42 and 52 effectively.

In addition, in the second variant, the metallic support member 72 includes the support member body 74, the heat sink 76 exposed to the external space, and the heat pipe 78 provided to couple the heat sink 76 to the support member body 74. Therefore, it is possible to efficiently transfer the heat of the light emitting diodes 42 and 52 from the support member body 74 to the heat sink 76 through the heat pipe 78, and to efficiently carry out a radiation to the external space in the heat sink 76.

Also, when the exposing position of the metallic support member 72 to the external space is not set into the lower wall portion 12*a* of the lamp body 12 as in the variant but is set into a side wall portion or an upper wall portion on the left or right of the lamp body 12, it is possible to efficiently cool the metallic support member 72 by the vehicle running wind. When the exposing position of the metallic support member 72 to the external space is set into the lower wall portion 12*a* of the lamp body 12 as in the variant, it is possible to seal the opening portion 12*b* by only attaching the packing 80 having a comparatively simple structure.

Next, description will be given to a third exemplary variant of the exemplary, non-limiting embodiment of the present invention.

Figure 8:
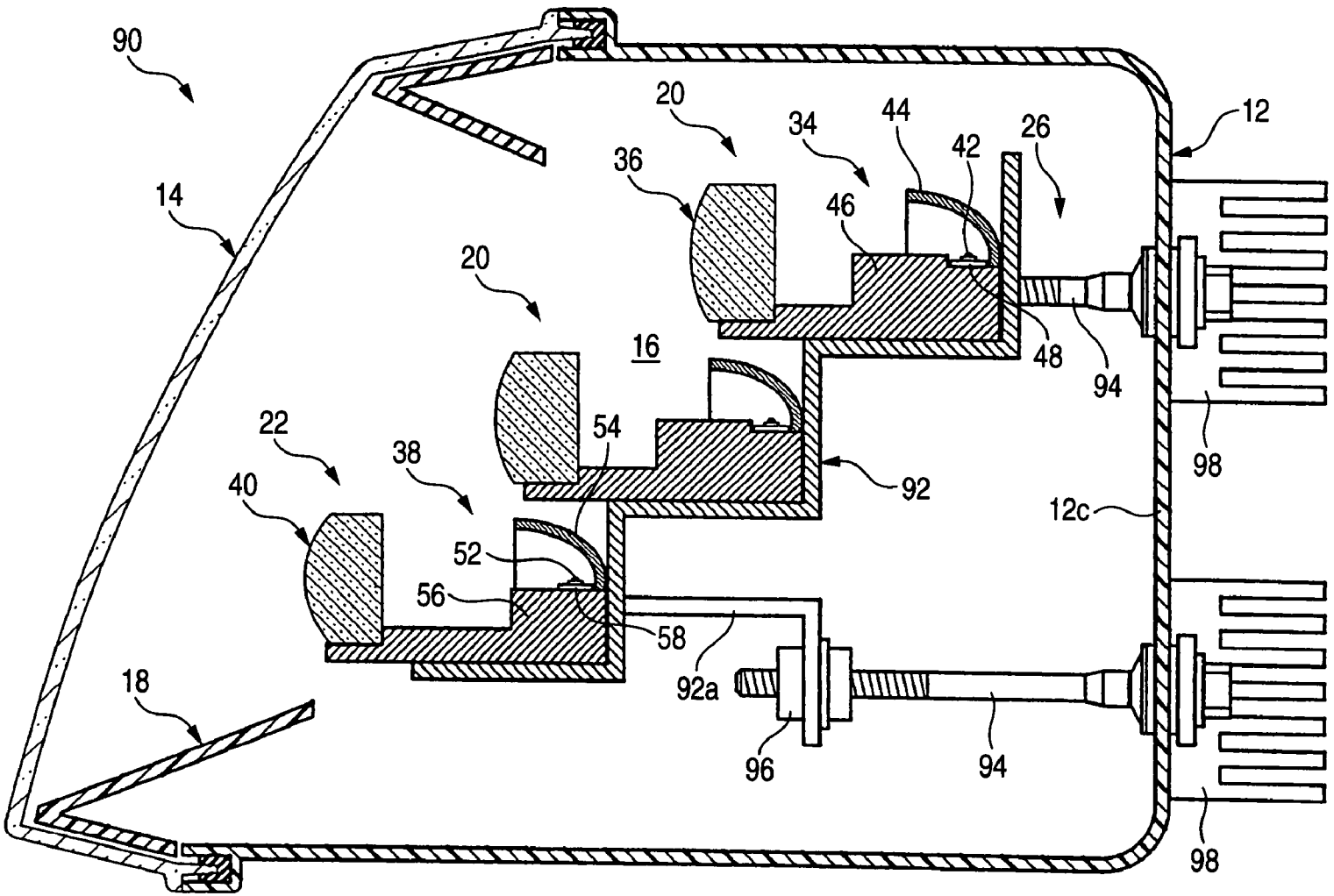
FIG. 8 is the same type of view as FIG. 2, illustrating a headlamp for a vehicle according to a third exemplary variant of the exemplary, non-limiting embodiment of the present invention.

FIG. 8 is the same view as FIG. 2, illustrating a headlamp 90 for a vehicle according to the variant. The headlamp 90 for a vehicle has the same basic structure as that of the first embodiment, while the structure of a metallic support member 92 is different from that of the metallic support member 24 according to this exemplary, non-limiting embodiment.

More specifically, the metallic support member 92 according to the variant has the same bracket 92*a* as that in the embodiment which is formed on a back face thereof and does not have the radiation fin 24*b* in the embodiment formed thereon, and is simply formed like a step. In the third variant, a plurality of aiming screws 94 constituting an aiming mechanism 26 is formed by a heat pipe, and each aiming nut 96 is constituted by a metal member, and furthermore, a plurality of heat sinks 98 are provided on the external surface of a rear wall portion 12*c* of a lamp body 12. Each of the heat sinks 98 is coupled to the base end of each of the aiming screws 94.

By employing the structure according to the variant, it is possible to obtain various functions and advantages. For example, but not by way of limitation, each of the aiming screws 94 is constituted by the heat pipe. Therefore, it is possible to radiate heat to the external space without forming a new opening portion on the lamp body 12. In the variant, particularly, each aiming nut 96 is constituted by the metal member, and furthermore, the external surface of the rear wall portion 12*c* of a lamp body 12 is provided with the heat sinks 98 to be coupled to the base ends of the aiming screws 94. Consequently, radiation efficiency can be enhanced sufficiently.

Next, description will be given to a fourth variant of the embodiment.

Figure 9:
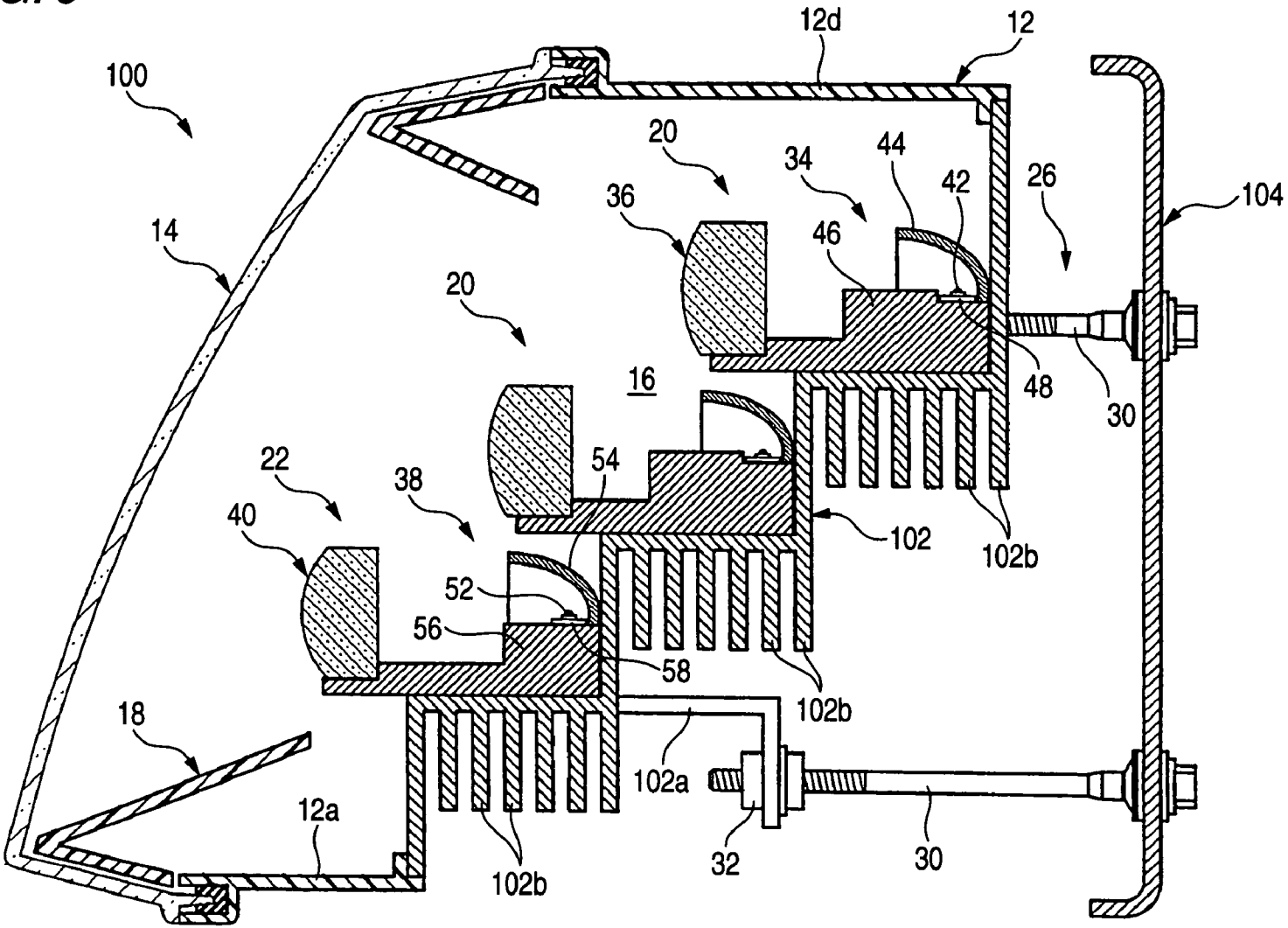
FIG. 9 is the same type of view as FIG. 2, illustrating a headlamp for a vehicle according to a fourth exemplary variant of the exemplary, non-limiting embodiment of the present invention.

FIG. 9 is the same view as FIG. 2, illustrating a headlamp 100 for a vehicle according to the fourth variant. The headlamp 100 for a vehicle has the same basic structure as that of the first embodiment illustrated in FIG. 2, while the structure of a metallic support member 102 is different from that of the metallic support member 24 according to this exemplary, non-limiting embodiment.

The metallic support member 102 according to the variant has the same bracket 102*a* as that of the embodiment formed on a back face thereof and a plurality of radiation fins 102*b* formed thereon. The metallic support member 102 constitutes a part of a lamp body 12. More specifically, the metallic support member 102 has both upper and lower ends extended and fixed to an upper wall portion 12*d* and a lower wall portion 12*a* of the lamp body 12. Consequently, the rear wall portion of the lamp body 12 is constituted.

In the fourth variant, the base ends of a plurality of aiming screws 30 constituting an aiming mechanism 26 are rotatably supported on a vertical plate 104 provided behind the metallic support member 102. The headlamp 100 for a vehicle according to the variant is attached to a car body through the vertical plate 104.

By employing the structure according to the variant, it is possible to obtain various functions and advantages. More specifically, in the fourth variant, a part of the lamp body 12 is constituted by the metallic support member 102. Therefore, the metallic support member 102 can be exposed to the external space of a lamp housing 16 over a wide range. Consequently, a rise in the temperatures of light emitting diodes 42 and 52 can be suppressed very effectively.

Instead of constituting a part of the lamp body 12 by the metallic support member 102 as in the variant, it is also possible to constitute the whole lamp body 12 by the metallic support member 102.

In the embodiment and each of the variants, it is also possible to integrally constitute the light source support blocks 46 and 56 of the lighting units 20 and 22 and the metallic support members 24, 62, 72, 92 and 102.

In the first and second variants, moreover, the sectional shape of each of the heat pipes 66 and 78 may have a great width in place of a circular shape. Consequently, it is possible to increase a contact area with each of the support member bodies 64 and 74, thereby enhancing a radiation efficiency still more. Moreover, the heat pipes 66 and 78 maybe directly come in contact with the light source support blocks 46 and 56 of the lighting units 20 and 22. Also, the radiation efficiency can be further enhanced.

In the second and third variants, it is also possible to separately provide a fan for cooling the heat sinks 76 and 98.

While the description has been given on the assumption that the 15 lighting units 20 and 22 are provided in the three upper and lower stages in the embodiment and each of the variants, it is a matter of course that the number and arrangement of the lighting units 20 and 22 may be properly changed depending on the pattern shapes of the light distribution pattern PL for a low beam and the light distribution pattern PH for a high beam and a luminous intensity distribution which are intended.

While the description has been given on the assumption that all of the 15 lighting units 20 and 22 are constituted as the projector type lighting units in the embodiment and each of the variants, it is a matter of course that the structures of other lighting units can also be employed.

The invention claimed is:

1. A headlamp for a vehicle, comprising:

a plurality of lighting units each comprising a semiconductor light emitting unit as a light source;

a lamp housing, accommodating said plurality of lighting units, comprising a lamp body, and a translucent cover attached to an opening portion on a front end of the lamp body, wherein a plurality of different light distribution patterns are formed by said plurality of lighting units; and an adjustable metal support member that supports said plurality of lighting units.

2. The headlamp for a vehicle according to claim 1, wherein the adjustable metal support member comprises a plate-shaped member formed in a step configuration.

3. The headlamp for a vehicle according to claim 1, further comprising a plurality of radiation fins positioned at a rear of the adjustable metal support member.

4. The headlamp for a vehicle according to claim 1, wherein the adjustable metal support member extends to a space external to the lamp housing.

5. The headlamp for a vehicle according to claim 4, wherein an exposing position of the metallic support member to the external space is positioned in a peripheral wall portion of the lamp body.

6. The headlamp for a vehicle according to claim 4, wherein the adjustable metal support member comprises:

a support member body;

a heat sink exposed to the external space; and a heat pipe provided to couple the heat sink to the support member body.

7. The headlamp for a vehicle according to claim 4, wherein at least a part of the lamp body comprises the metallic support member.

8. The headlamp for a vehicle according to claim 1, wherein a part of the adjustable metal support member comprises at least one heat pipe extended to a vicinal position of a lower end of the translucent cover.

9. The headlamp for a vehicle according to claim 1, wherein the adjustable metallic support member is tiltably supported by a plurality of aiming screws, and at least one of the aiming screws comprises a heat pipe.

10. The headlamp for a vehicle according to claim 1, wherein each of the plurality of lighting units further comprising a reflector and a projection lens.

11. The headlamp for a vehicle according to claim 10, wherein:

each of the lighting units further comprise a metallic support block supporting the light source, reflector and projection lens; and the metallic support block defines the light distribution pattern of each of the lighting units.

12. The headlamp for a vehicle according to claim 1, further comprising a plurality of heat fins extending from the adjustable metal support member, wherein the heat fins are enclosed within the lamp housing.

13. The headlamp for a vehicle according to claim 1, further comprising a heat pipe extending along the adjustable metal support member to a vicinal position of a lower end of the translucent cover.

14. The headlamp for a vehicle according to claim 1, further comprising:

adjustment screws connecting the adjustable metal support member to a rear side of the lamp housing; and a heat sink, connected to the adjustable metal support member, and extending out of a bottom side of the lamp housing.

15. The headlamp for a vehicle according to claim 1, further comprising:

a heat sink on an outer rear side of the lamp housing; and an adjustment screw connecting the adjustable metal support member to a rear side of the lamp housing and the heat sink, the adjustment screw comprising a heat pipe.

16. The headlamp for a vehicle according to claim 1, wherein:

the lamp housing comprises a second opening on a rear end of the lamp body;

the adjustable metal support member is fixed to the second opening to form a rear side of the lamp housing;

the headlamp further comprises an adjustment screw connecting the rear side of the lamp housing to the vehicle.

17. An apparatus for a vehicle lighting system including a headlight having a housing that includes a translucent cover and a body, comprising:

a plurality of light emitting devices arranged in a pattern on a support positioned in said body; and a means for removing heat generated by at least one of said light emitting devices, wherein:

said light emitting devices are configured to produce a plurality of different light distribution patterns; and said support is adjustable.

18. The apparatus of claim 17, wherein said means for removing heat comprises a plurality of fins directly attached to said support.

19. The apparatus of claim 18, wherein said plurality of fins is positioned on one of a bottom surface of said support and a rear surface of said support.

20. The apparatus of claim 19, wherein when said plurality of fins is positioned on said bottom surface, said support and said plurality of fins form a portion of said housing such that said fins are positioned outside of said body.

21. The apparatus of claim 19, wherein said plurality of fins is positioned inside said body.

22. The apparatus of claim 17, wherein said means for removing comprises a plurality of fins connected to said support.

23. The apparatus of claim 22, wherein said plurality of fins is connected to said support via a connector attached to a lower surface of a bottom step of said support, and is sealed by a flexible seal, on an outer surface of said body.

24. The apparatus of claim 22, wherein said plurality of fins is connected to said support via a means for adjusting said support, and is on an outer surface of said body.

25. The apparatus of claim 17, wherein said means for removing heat comprises a pipe device attached to a surface of said support.

26. The apparatus of claim 25, further comprising a vicinal part attached to said pipe at a lower front portion of said pipe and inside said body.

27. The apparatus of claim 25, further comprising a plurality of fins connected to said pipe by a connector, wherein said fins are positioned substantially outside said body.

28. The headlamp for a vehicle according to claim 17, wherein each of the plurality of light emitting devices comprises a semiconductor light emitting unit as a light source, a reflector, and a projection lens.

29. The apparatus according to claim 28, wherein:

each of the light emitting devices further comprise a metallic support block supporting the light source, reflector and projection lens; and the metallic support block defines the light distribution pattern of each of the lighting units.

30. The apparatus according to claim 17, wherein the means for removing heat comprises:

an adjustable metal support member; and a plurality of heat fins extending from the adjustable metal support member, wherein the heat fins are enclosed within the housing.

31. The apparatus according to claim 17, wherein the means for removing heat comprises:

an adjustable metal support member; and a heat pipe extending along the adjustable metal support member to a vicinal position of a lower end of the translucent cover.

32. The apparatus according to claim 17, wherein:

the means for removing heat comprises an adjustable metal support member;

the headlight further comprises an adjustment screw connecting the adjustable metal support member to a rear side of the housing; and the headlight further comprises a heat sink, connected to the adjustable metal support member, and extending out of a bottom side of the lamp housing.

33. The apparatus according to claim 17, wherein:

the means for removing heat comprises an adjustable metal support member;

the headlight further comprises a heat sink on an outer rear side of the lamp housing; and the headlight further comprises an adjustment screw connecting the adjustable metal support member to a rear side of the lamp housing and the heat sink, the adjustment screw comprising a heat pipe.

34. The apparatus according to claim 17, wherein:

the means for removing heat comprises an adjustable metal support member;

the housing comprises an opening on a rear end thereof;

the adjustable metal support member is fixed to the second opening to form a rear side of the housing; and the headlight further comprises an adjustment screw connecting the rear side of the housing to the vehicle.

* * * * *